United States Patent [19]

Kohyama et al.

[11] Patent Number: 4,616,918

[45] Date of Patent: Oct. 14, 1986

[54] DEVELOPING APPARATUS

[75] Inventors: Mitsuaki Kohyama, Tokyo; Takashi Shimazaki, Kawasaki, both of Japan

[73] Assignee: Kabushiki Kaisha Toshiba, Kawasaki, Japan

[21] Appl. No.: 636,605

[22] Filed: Aug. 1, 1984

[30] Foreign Application Priority Data

Aug. 4, 1983 [JP] Japan ..... 58-143340

[51] Int. Cl.[4] ..... G03G 15/08

[52] U.S. Cl. ..... 355/3 DD; 118/261; 118/656

[58] Field of Search ..... 355/3 DD, 3 R; 118/656, 118/657, 658, 261, 653

[56] References Cited

U.S. PATENT DOCUMENTS

| | | | |
|---|---|---|---|
| 3,176,652 | 4/1965 | Mott et al. | 118/658 |
| 3,639,051 | 2/1972 | Charlap et al. | 355/3 DD |
| 4,018,187 | 4/1977 | Abbott et al. | 118/658 |
| 4,136,637 | 1/1979 | Snelling | 118/658 |
| 4,331,101 | 5/1982 | Müller et al. | 118/658 |
| 4,395,110 | 7/1983 | Hosono et al. | 355/3 DD |

FOREIGN PATENT DOCUMENTS 3212865 4/1982 Fed. Rep. of Germany .

*Primary Examiner*—R. L. Moses

*Attorney, Agent, or Firm*—Cushman, Darby & Cushman

[57] ABSTRACT

A developing apparatus is constructed so that a first rugged surface portion is formed on that portion of the surface of an elastic blade which faces and is pressed against a developing roller, thereby reducing the conveying force to carry the developing agent in contact with the first rugged surface portion under the pressure of the elastic blade. In this way, the layer of the developing agent flowing to the contact point between the developing roller and the elastic blade is gradually thinned to form a uniformly thin layer of developing agent on the surface of the developing roller.

15 Claims, 15 Drawing Figures

DEVELOPING APPARATUS

BACKGROUND OF THE INVENTION

The present invention relates to a developing apparatus for depositing a developing agent on an image carrier with a latent image thereon, thereby developing the latent image.

Development is achieved, for example, when a developing agent (colored powder called toner) charged for a potential difference from electric charges forming an electrostatic latent image is electrostatically attracted to the electrostatic latent image. Developing agents include one-component developing agents which consist of a powdery toner only or a toner coated with $SiO_2$ or another additive, and two-component developing agents which are composed of a powdery toner and a carrier as it is called, such as magnetic powder or fine resin powder, glass, etc. In the two-component developing agents, the toner is securely charged by friction with the carrier. To maintain a constant developing density, on the other hand, the mixture ratio between toner and carrier, i.e., toner density, must be kept constant. Requiring no such control of toner density, the one-component developing agents surpasses the two-component developing agents in easy handling.

The one-component developing agents are classified into two types, magnetic and nonmagnetic. In general, a nonmagnetic developing agent is prepared by mixing resin powder with a color agent such as carbon, while a magnetic developing agent is a mixture of resin powder and magnetic powder.

A prior art method using a one-component developing agent is an application of the so-called no-contact developing process stated in Japanese Patent Publication No. 9475/66. In this developing process, an image carrier is opposed to a layer of a developing agent on a developing agent carrier at a fixed space, and a suitable bias is applied to the developing agent layer to fly the developing agent to image portions of an electrostatic latent image on the image carrier. The no-contact developing process is superior to any other developing methods in the following points. Since a developing agent with electric insulating property or high resistance can be used in the process, there is no possibility of defective transfer. Moreover, the developing agent will not cause fog, since it will not be flown to the no-image portions of the electrostatic latent image. In developing an electrostatic latent image by the no-contact developing process, the distance between the image carrier and the developing agent carrier must be minimized for a visible image of higher quality. Naturally, therefore, the developing agent layer on the developing agent carrier needs to be very thin and uniform.

In order to form such a thin layer of developing agent, a film forming method is disclosed in Japanese Patent Disclosure No. 43047/79 in which a thin layer of a magnetic developing agent is formed on a developing agent carrier containing magnetic field generating means therein. According to this method, a uniformly thin layer of magnetic developing agent can be formed with high reliability. Thus, a satisfactory visible image may be obtained by the use of the no-contact developing process.

The no-contact developing process, however, requires as indispensable requisites a magnetic field generating means, i.e., a magnet, and a magnetic developing agent composed of toner and magnetic powder dispersed therein. Thus, this developing process has the following drawbacks:

(1) the use of the magnet in the developing agent carrier renders the apparatus complicated and expensive, constituting a hindrance to the reduction of the size and weight of the apparatus, (2) the magnetic developing agent is more expensive than the nonmagnetic one, and (3) containing magnetic powder, the magnetic developing agent is poor in coloring capability and is unsuited for color print.

Thus, the no-contact developing process using the magnetic developing agent has the substantial drawbacks attributed to the use of the magnetic developing agent, as well as many advantages.

Meanwhile, a no-contact developing process using a nonmagnetic developing agent may be considered an ideal developing method which can settle all the problems related to the prior art method. However, this alternative process has one major problem in that the use of the nonmagnetic developing agent makes it difficult to form a uniformly thin layer of the developing agent stably on the developing agent carrier. Therefore, this method has not yet been put to practical use. If the thin layer of the developing agent is not uniform, the amount of the developing agent flown to the electrostatic latent image is rendered partially uneven, preventing the formation of a good-quality visible image (image formed by flying the developing agent to an electrostatic latent image).

In order to form a thin layer of the nonmagnetic developing agent, an elastic blade is pressed against the surface of the developing agent carrier. The width of a developing region of the developing agent carrier surface to be coated with the developing agent under contact pressure from the elastic blade need only be equal to the maximum developing width, i.e., the maximum image forming width. If the developing agent is applied to nondeveloping regions, it will scatter or leak from these regions to prevent the formation of the thin layer or soil the visible image on the surface of the image carrier. However, the prior art apparatus is not provided with any means for applying the developing agent separately to the developing and nondeveloping regions of the developing agent carrier. Conventionally, therefore, it is impossible to obtain a high-quality visible image.

SUMMARY OF THE INVENTION

The present invention is contrived in consideration of these circumstances and is intended to provide a developing apparatus capable of forming a uniformly thin layer of a developing agent on a developing agent carrier to produce a visible image of good quality, even though the developing agent is a one-component nonmagnetic developing agent.

In order to achieve the above object, a developing apparatus according to a first aspect of the invention is constructed so that a first rugged surface portion is formed on that part of the surface of an elastic member which faces and is pressed against a developing agent carrier, thereby reducing the conveying force to carry the developing agent in contact with the first rugged surface portion under the pressure of the elastic member. In this way, the layer of the developing agent flowing to the contact point between the developing agent carrier and the elastic member is gradually thinned to form a uniformly thin layer of developing agent on the surface of the developing agent carrier.

In a developing apparatus according to a second aspect of the invention, a second rugged surface portion and smooth surfaces on each side thereof are formed on the surface of the developing agent carrier. The depth of the second rugged surface portion below the smooth surfaces is set so that the surface of a thin layer of the developing agent on the second rugged surface portion is substantially flush with the smooth surfaces. The elastic member can be evenly pressed against the developing agent carrier, so that a uniform thin layer of the developing agent can be formed on the second rugged surface portion. Moreover, the developing agent is effectively prevented from being applied to the smooth surfaces and from leaking sideways.

In a developing apparatus according to a third aspect of the invention, the second rugged surface portion and the smooth surfaces on each side thereof are formed on the surface of the developing agent carrier, and third rugged surface portions are formed on those portions of the elastic member which face the smooth surfaces of the developing agent carrier. Thus, the conveying force to carry the developing agent under contact pressure between the second rugged surface portion and the elastic member is increased, and the conveying force to carry the developing agent in contact with the third rugged surface portions is decreased, thereby preventing the developing agent from being applied to the smooth surfaces.

DETAILED DESCRIPTION OF THE PREFERED EMBODIMENTS

One embodiment of a developing apparatus according to the present invention applied to an image forming apparatus will now be described in detail with reference to the accompanying drawings of FIGS. 1 to 6.

Figure 1:
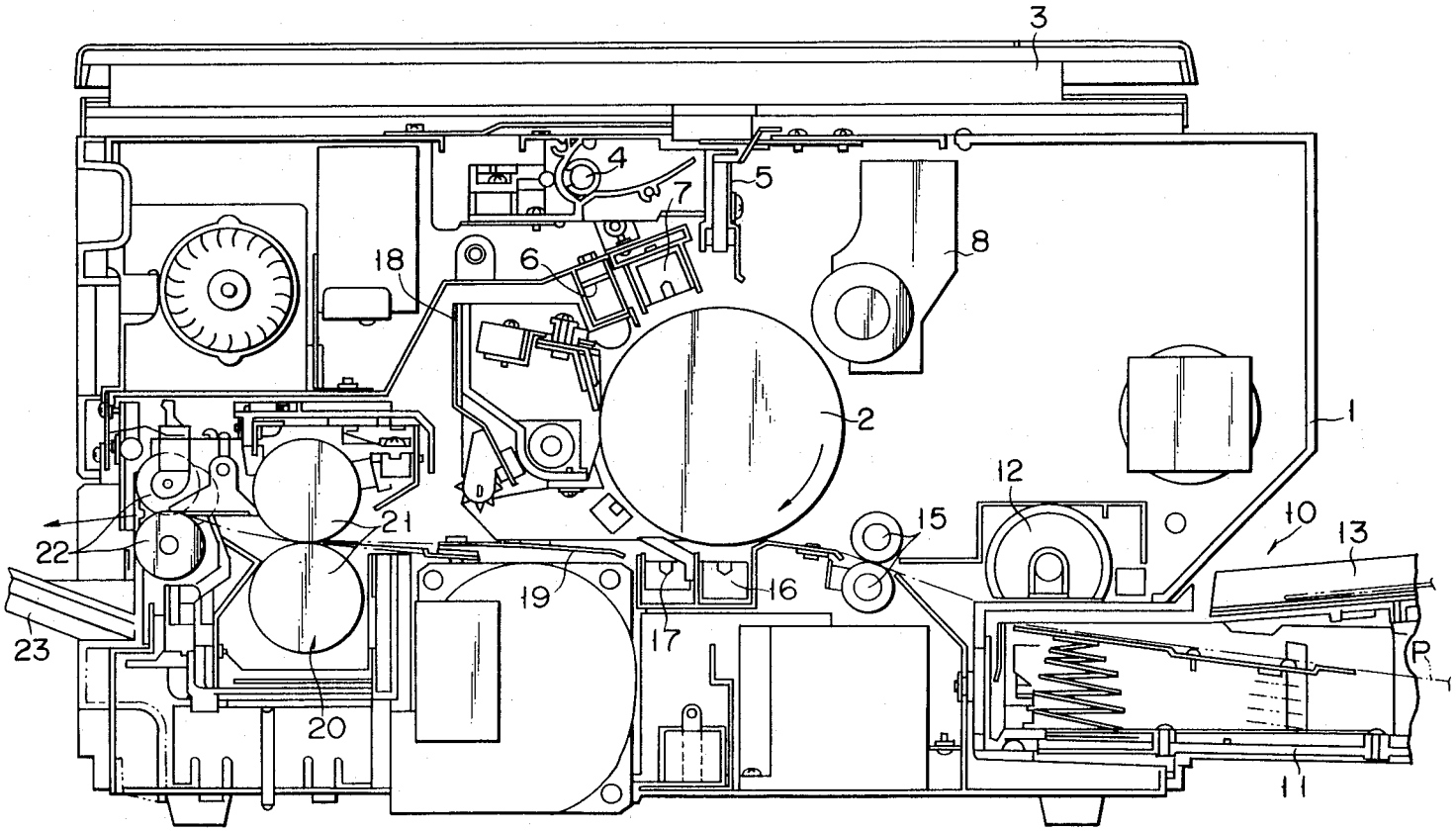
FIG. 1 is a sectional view schematically showing a copying machine using a developing apparatus according to the present invention.

First, the image forming apparatus, e.g., a copying machine, using the developing apparatus of the invention will be described. FIG. 1 is a sectional view schematically showing the copying machine. In FIG. 1, numeral 1 designates a housing of the copying machine. Rotatably disposed in the central portion of the housing 1 is an image carrier, e.g., a photoconductive drum 2 made of selenium, on the surface of which is formed an electrostatic latent image. The photoconductive drum 2 is surrounded by a lamp 4 and a convergent light transmitting member 5 for optically scanning an original paper put on a horizontally reciprocating original table 3 and for forming an electrostatic latent image corresponding to an image of the original paper on the surface of the photoconductive drum 2, a discharge lamp 6 for de-electrifying the surface of the photoconductive drum 2 before the formation of the original image, a charger 7 for uniformly charging the surface of the photoconductive drum 2 after the de-electrification, and a developing apparatus 8 according to the invention for selectively flying a developing agent to the electrostatic latent image on the surface of the photoconductive drum 2 to develop the electrostatic latent image. Thus, the developing apparatus 8 forms a visible image on the surface of the photoconductive drum 2.

A paper feeding section 10 is provided at one side portion (right-hand side portion of FIG. 1) of the housing 1. The paper feeding section 10 includes a paper cassette 11 removably attached to the one side portion of the housing 1, a paper supply roller 12 in rolling contact with the uppermost one of sheets P contained in the paper cassette 11 and capable of delivering the sheets P one by one into the housing 1, and a sheet-bypass guide 13 for manual paper supply. Each sheet P delivered from the paper feeding section 10 is regulated for feed timing by a pair of aligning rollers 15, and fed so as to be in rolling contact with the photoconductive drum 2 in a transfer section.

The photoconductive drum 2 is also surrounded by a pre-transfer charger 9, a transfer charger 16 for transferring the developing agent to the sheet to form a visible image thereon, and a separation charger 17 for separating the sheet from the photoconductive drum 2 after transfer. The transfer section is defined between the photoconductive drum 2 and the transfer charger 16. After the developing agent image (visible image) is transferred to the sheet, the sheet is guided to a fixing unit 20 by a conveyor belt 19. The developing agent is fixed by the pressure and heat of a pair of heat rollers 21 which constitute the fixing unit 20. After the fixation, the sheet is discharged onto a tray 23 by a pair of exit rollers 22. After the transfer operation, the developing agent remaining on the surface of the photoconductive drum 2 is removed by a cleaning unit 18.

Figure 2:
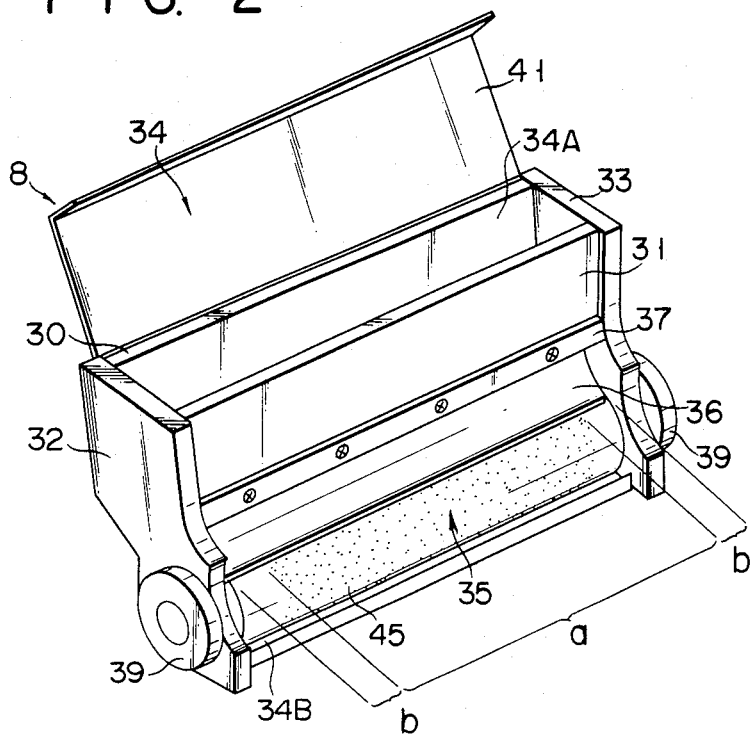
FIG. 2 is a perspective view schematically showing a developing apparatus according to a first embodiment of the invention.
Figure 3:
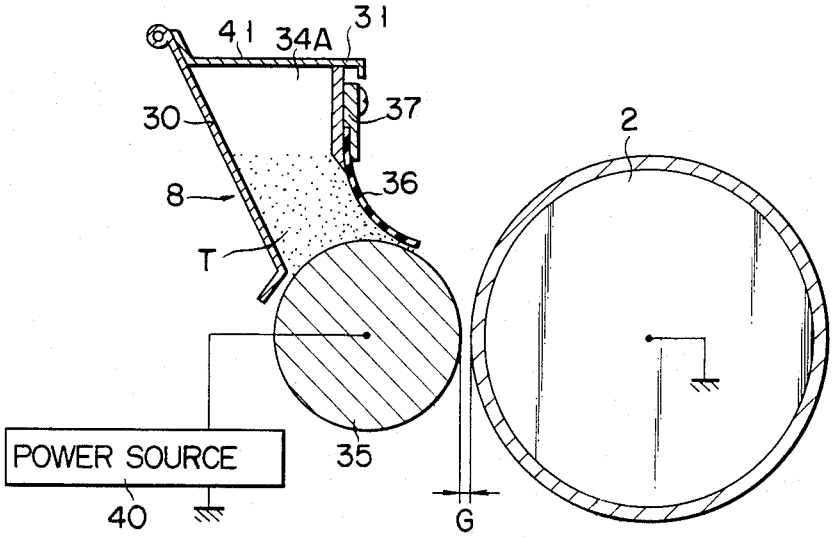
FIG. 3 is a sectional view schematically showing the developing apparatus of FIG. 2.

The developing apparatus 8 according to the first embodiment of the invention will be described in detail. FIGS. 2 and 3 are a perspective view and a sectional view, respectively, schematically showing the developing apparatus 8.

The developing apparatus 8 has a housing 34 which contains a nonmagnetic developing agent. The housing 34 is provided with a back frame 30 and a front frame 31 spaced from each other and side frames 32 and 33 attached to both side portions of the frames 30 and 31. The housing 34 is open at both the top and bottom and has a swingable cover member 41 at its top opening 34A. When the cover 41 is up, the developing agent is supplied through the top opening 34A. Disposed near a bottom opening 34B of the housing 34 is a rotatable developing agent carrier, e.g., an aluminum or stainless-steel developing roller 35, which carries the developing agent on its surface. The developing roller 35 is pivotally mounted on the two side frames 32 and 33.

The front frame 31 is fitted with an elastic blade 36 by means of a blade holder 37. The elastic blade 36 is formed of, e.g., silicone-butadiene rubber, urethane rubber, stainless steel, phosphor bronze (approximately 0.07 to 0.2 mm in thickness), or urethane sheet. The elastic blade 36 is pressed against the surface of the developing roller 35 to coat the surface with the developing agent T. The contact pressure between the elastic blade 36 and the developing roller 35 can be finely adjusted by controlling the position of the blade holder 37.

Part of the surface of the elastic blade 36 opposed to the developing roller 35 is in surface contact with the developing roller 35. Therefore, the contact area between the elastic blade 36 and the developing roller 35 is wider than in the case of the prior art construction in which the free end portion of the elastic blade is pressed against the developing roller. Thus, the fine adjustment of the contact pressure on the developing roller 35 is easy, and the contact pressure can be made uniform. Also, the developing agent can enjoy friction under the contact pressure for a longer time, thus acquiring uniform and sufficient electric charges.

The developing apparatus 8 is located in a position such that the developing agent layer on the developing roller 35 is not in contact with the photoconductive drum 2. A gap G between the developing roller 35 and the photoconductive drum 2 depends on the particle size of the developing agent and the thickness of the developing agent layer. To ensure the flight of the developing agent for a visible image of good quality, it is necessary to minimize the gap G. The gap G can be narrowed only if the developing agent layer on the developing roller 35 is a thin layer. The range of the particle size of the developing agent used depends on the resolution of the desired image. Thus, the practical gap G between the developing roller 35 and the photoconductive drum 2 ranges from approximately 10 to 300 microns. Here the thin layer may be a monolayer or a multilayer, including up to six or seven layers, of the developing agent.

To maintain the accuracy of the gap G, a pair of gap control rollers 39 are mounted on the shaft of the developing roller 35 so as to be rotatable in a body. The gap control rollers 39 come into contact with both side portions of the peripheral surface of the photoconductive drum 2 or engaging rollers (not shown) mounted on the shaft of the photoconductive drum 2, thereby keeping the intercentral distance between the photoconductive drum 2 and the developing roller 35. A power source 40 is provided for applying a voltage to the developing roller 35 to form an electric field between the photoconductive drum 2 and the developing roller 35 and generally includes D.C. power source or deviated A.C. power source. The power source 40, which is not requisite for the developing apparatus 8 of the invention, serves to facilitate the flight of the developing agent on the developing roller 35 to the surface of the photoconductive drum 2 by forming the electric field between the two members 2 and 35. The developing agent frictionally charged on the developing roller 35 is transferred to the surface of the photoconductive drum 2 by only an electrostatic attraction attributed to latent image charges on the surface of the photoconductive drum 2.

Figure 4:
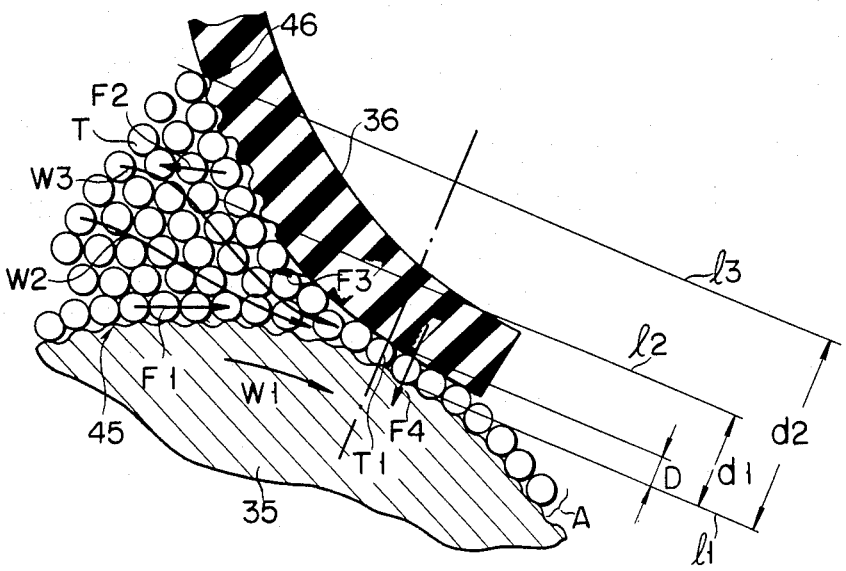
FIG. 4 is a sectional view showing how an elastic plate is pressed against a developing roller in the developing apparatus of FIG. 2.

The developing roller 35 and the elastic blade 36 will now be described in detail. As shown in FIG. 4, a first rugged surface portion 46 is formed on part of the surface of the elastic blade 36 which faces the developing roller 35, while a second rugged surface portion 45 is formed on the peripheral surface of the developing roller 35.

Figure 5:
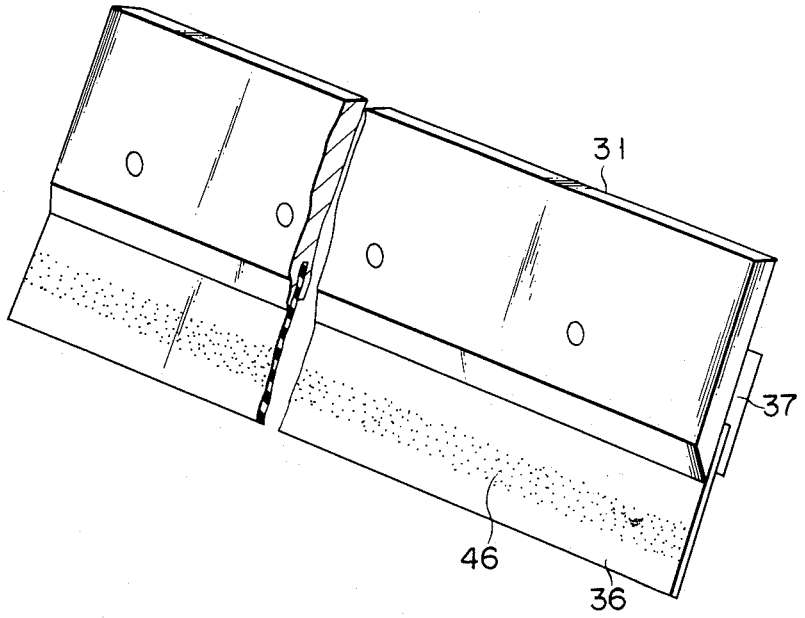
FIG. 5 is a perspective view schematically showing the elastic blade.

As shown in FIG. 4, the first rugged surface portion 46 is located in a region not in contact with a monolayer A of the developing agent, which is sandwiched between the developing roller 35 and the elastic blade 36. More specifically, the first rugged surface portion 46 is formed on the lower side surface of the elastic blade 36 in a region between parallel lines l2 and l3. Here the line l2 is parallel to and at a distance dl (twice or thrice the particle size D of the developing agent) from a tangent line l1 which touches the circumference of the developing roller 35 at the contact point between the developing roller 35 and a specific developing agent particle T1 under contact pressure, and the line l3 is at a distance d2 (10 to 50 times the particle size D) from the tangent line l1. As shown in FIG. 5, the first rugged surface portion 46 extends over the full length of the elastic blade 36 along the axial direction of the developing roller 35. The first rugged surface portion 46 is roughed by sand blasting or buffing so that its roughness ranges from 0.1D to 2.0D where D is the particle size of the developing agent.

Likewise, the second rugged surface portion 45 is roughed by sand blasting or buffing so that its roughness ranges from 0.07D to 1.5D. As shown in FIG. 2, the second rugged surface portion 45 is formed in a developing region or a peripheral surface region of a maximum developing width (a), which is substantially equal to the maximum image forming width of the photoconductive drum 2. A nondeveloping region of a nondeveloping width (b) is formed on each side of the developing region. The nondeveloping region is not roughed and has a smooth surface.

The operation and function of the developing apparatus 8 will now be described. The housing 34 of the developing apparatus 8 is filled with the developing agent T, and the developing roller 35 is rotated in the clockwise direction indicated by arrow W1 in FIG. 4. The developing agent T is fed in the direction of arrow W1 by the conveying force of the developing roller 35 and another agency. In this process, the developing agent T is frictionally charged between the developing roller 35 and the elastic blade 36. Since the second rugged surface portion 45 is formed on the surface of the developing roller 35, the conveying force F1 of the developing roller 35 to carry the developing agent T in contact with or near the surface of the developing roller 35 is increased. Thus, the developing agent T near the developing roller 35 is securely fed in the direction of arrow W1. The developing agent in contact with the first rugged surface portion 46 of the elastic blade 36 is subjected to a relatively large resisting force F2, and the flow of the developing agent T becomes slower as it approaches the first rugged surface portion 46. Since the lower-course side (corresponding to the range of the distance d1 of FIG. 4) of the surface of the elastic blade 36 with respect to the first rugged surface portion 46 is smooth, the developing agent T touching that surface portion is subjected to only a relatively small resisting force F3 and can flow smoothly.

Since the first rugged surface portion 46 is not formed on the prior art elastic blade, only a relatively small resisting force acts on the developing agent along the elastic blade. In the prior art apparatus, therefore, the developing agent tends to rush to the contact point between the elastic blade and the developing roller from a relatively wide range, as indicated by arrow W3. Thus, the flow of the developing agent becomes dull, possibly causing cohesion of the developing agent or production of voids.

In this first embodiment, however, the developing agent T directed toward the contact point to receive a thrusting force F4 of the elastic blade 36 flows actively and smoothly within a narrow range close to the developing roller 35, as indicated by arrow W2. The layer of the flowing developing agent is gradually reduced in thickness as it approaches the lower-course side of the elastic blade 36. As a result, a uniformly thin layer of the developing agent is applied to the developing roller 35 by the lower-course side portion of the elastic blade 36. Thus, the developing agent directed toward the contact point of the elastic blade 36 flows smoothly, and the thickness of the layer of the flowing developing agent is gradually reduced. Consequently, the developing agent T may securely be prevented from forming an uneven, thin layer or being irregularly charged as the elastic blade 36 is unduly forced up by an uneven or irregular flow of the developing agent T or by foreign matter mixed therein.

When a uniformly thin film of the developing agent T is formed on the surface of the developing roller 35, the frictionally charged developing agent T forming the thin layer is selectively flown to the electrostatic latent image on the surface of the photoconductive drum 2 by the agency of the electric field formed between the developing roller 35 and the photoconductive drum 2. Thus, the electrostatic latent image is developed into a visible image. Since the thin layer of the developing agent applied to the developing roller 35 is uniform, the selectively flown developing agent is also uniform at every part of the electrostatic latent image, ensuring production of a visible image of high quality. For the same reason, the gap G between the developing roller 35 and the photoconductive drum 2 need only be a little wider than the thickness of the thin layer. Thus, the gap G can be minimized to secure the flight of the developing agent for the development of a satisfactory visible image. The uniformly thin layer of the developing agent permits no-contact development with use of a one-component, nonmagnetic developing agent. In the no-contact development, a layer of a developing agent applied to a developing agent carrier is opposed to an image carrier so that the developing agent is flown only to an electrostatic latent image on the image carrier. Thus, the developing apparatus 8 of the invention can be applied with high reliability to superpositive development, which is essential for color printing, and the image carrier can securely be prevented from breakage due to contact with the developing agent carrier or from deterioration with the passage of time.

An example of the developing apparatus 8 will now be explained. The density unevenness of images, obtained with use of the roughness of the first rugged surface portion 46 as a parameter, was examined in the following conditions for the first embodiment.

(a) Developing agent used: Nonmagnetic developing agent with average particle size of 12 microns. (b) Gap G between the developing roller 35 and the photoconductive drum 2: 100 to 300 microns.

(c) Linear contact pressure of the elastic blade 36 on the surface of the photoconductive drum 2: 10 to 20 g/cm.

(d) Distance d1 (FIG. 4): 25 to 40 microns.

(e) Roughness of the second rugged surface portion 45 (surface of an aluminum drum roughed by sand blasting, measured in accordance with JIS B0601): 10 to 20 microns.

Figure 6:
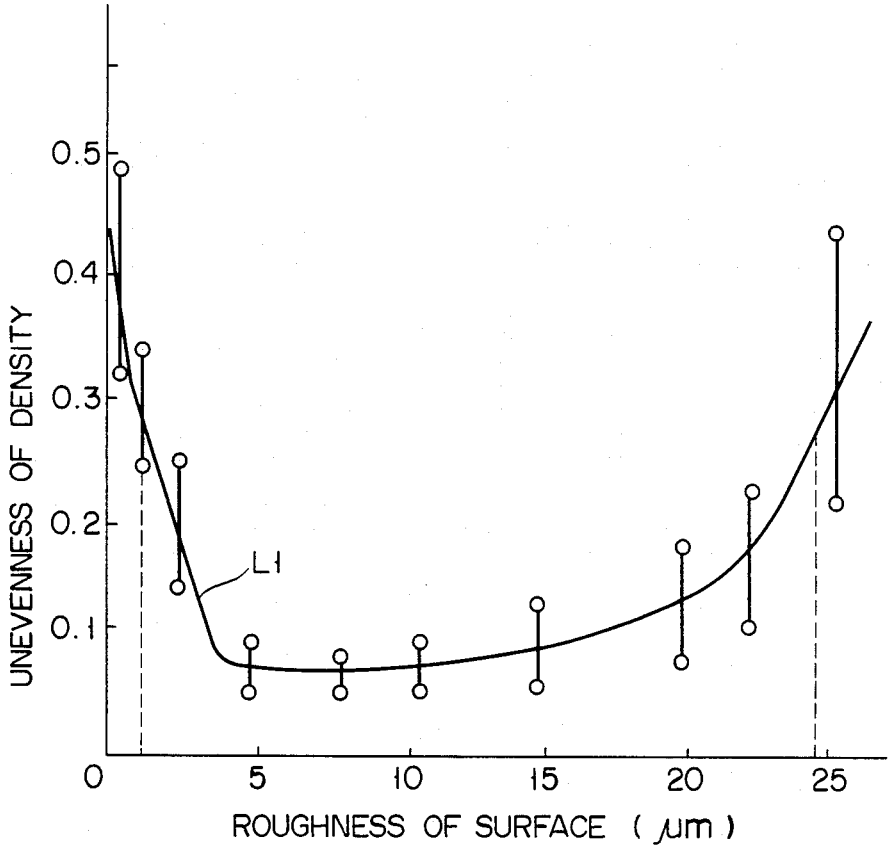
FIG. 6 is a graph showing the results of a test conducted on the developing apparatus according to the first embodiment.

The results of the test are shown in the graph of FIG. 6. In FIG. 6, the ranges of the density unevenness for various values (microns) of roughness of the first rugged surface portion 46 are represented by vertical lines, while the correlation between the roughness of surface and the unevenness of density is represented by curve L1. The density unevenness is determined by subtracting a minimum density dmin from a maximum density dmax obtained by measuring the density at a plurality of blank portions. As seen from curve L1 of FIG. 6, an image of relatively high quality with a density unevenness of about 0.3 or less can be obtained with use of the roughness of the first rugged surface portion 46 ranging from 1.0 to 24 microns. This surface roughness is equal to about 0.1 to 2 times the particle size of the developing agent. For higher image quality, the surface roughness should preferably be about half the particle size of the developing agent.

It is to be understood that the present invention is not limited to the first embodiment, and that the members used in the first embodiment may be replaced with other members having the same functions. For example, the nonmagnetic developing agent may be replaced with a one-component, magnetic developing agent. The developing agent carrier is not limited to the metallic drum and may be a metallic plate or a belt. Also, the developing agent carrier may be treated with Alumite or plated with chromium. With such surface treatment, the surface of the developing agent carrier, e.g., the second rugged surface portion 45, may be protected against abrasion, and the developing agent carrier can enjoy longer life. The electrostatic latent image the developing apparatus 8 can develop is not limited to the one formed by the copying machine shown in FIG. 1 and may be any patterns of charged particles which are formed by a cathode-ray tube, laser beam, need electrode, or light emitting diode.

Figure 7:
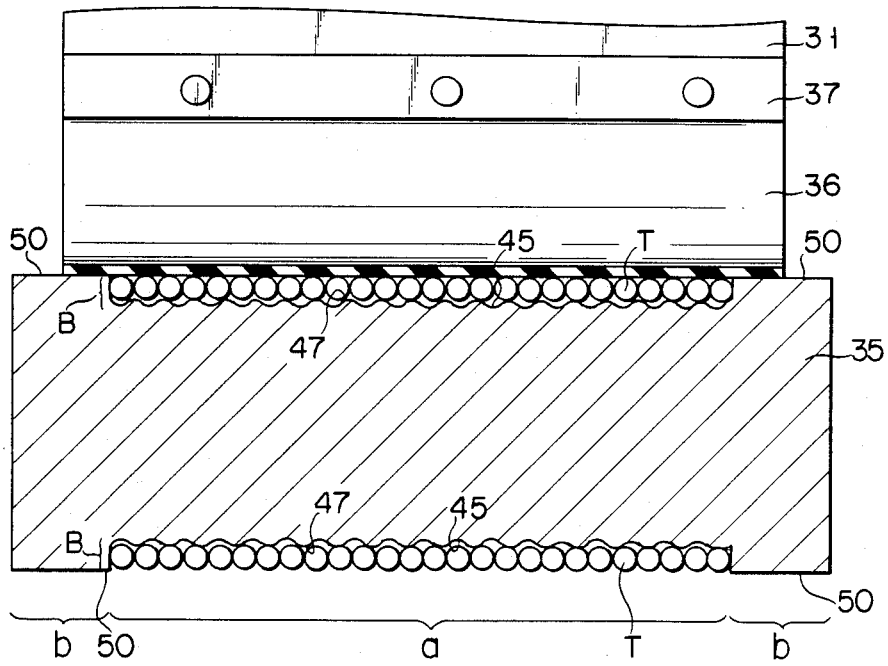
FIG. 7 is a sectional view schematically showing the principal part of a developing apparatus according to a second embodiment of the invention.

A developing apparatus according to a second embodiment of the invention will now be described in detail. This developing apparatus may also be applied to the copying machine shown in FIG. 1, and has substantially the same outline as shown in FIGS. 2 and 3. The second embodiment differs from the first embodiment in that a recess 47 is formed in the developing region on the peripheral surface of the developing roller 35 having the maximum developing width (a), as shown in the sectional view of FIG. 7. Thus, the second rugged surface portion 45 of the developing roller 35 is formed on the bottom surface of the recess 47. The nondeveloping regions (with the nondeveloping width (b)) on each side of the second rugged surface portion 45 have smooth surfaces 50 (smoother than the second rugged surface portion 45). The depth B of the recess 47, i.e., the height of the smooth surfaces 50 above the second rugged surface portion 45, is set so that the surface of the thin layer A of the developing agent T on the second rugged surface portion 45 is substantially flush with the smooth surfaces 50. In this case, the average depth B of the recess 47 depends on the roughness of its surface. In the second embodiment, as compared with the first embodiment using the first rugged surface portion 46, the surface of the elastic blade 36 pressed against the developing roller 35 need not be roughed.

The elastic blade 36 is pressed against the developing roller 35 constructed in this manner. When the developing agent is carried between the developing roller 35 and the elastic blade 36 while being frictionally charged, the developing agent applied to the second rugged surface portion 45 in the recess 47 is restricted to the thin layer A defined by the depth of the recess 47. Moreover, the surface of the thin layer A is substantially flush with the smooth surfaces 50. Accordingly, the elastic blade 36 is evenly pressed against the thin layer A and the surface of the developing roller 35 without bending upward or downward at each end. Thus, the contact pressure on the developing agent may securely be prevented from becoming uneven to vary the layer thickness. For the same reason, moreover, the developing agent T cannot easily move sideways, checked by the lateral faces of the recess 47, around the boundary between the second rugged surface portion 45 and the smooth surfaces 50. Also, the elastic blade 36 is fully pressed against the smooth surfaces 50, and the conveying force of the smooth surfaces 50 is very small owing to their smoothness. Thus, the developing agent may effectively be prevented from leaking sideways. In other words, the region of the developing roller 35 to be coated with the developing agent may be regulated with high reliability.

Figure 8A:
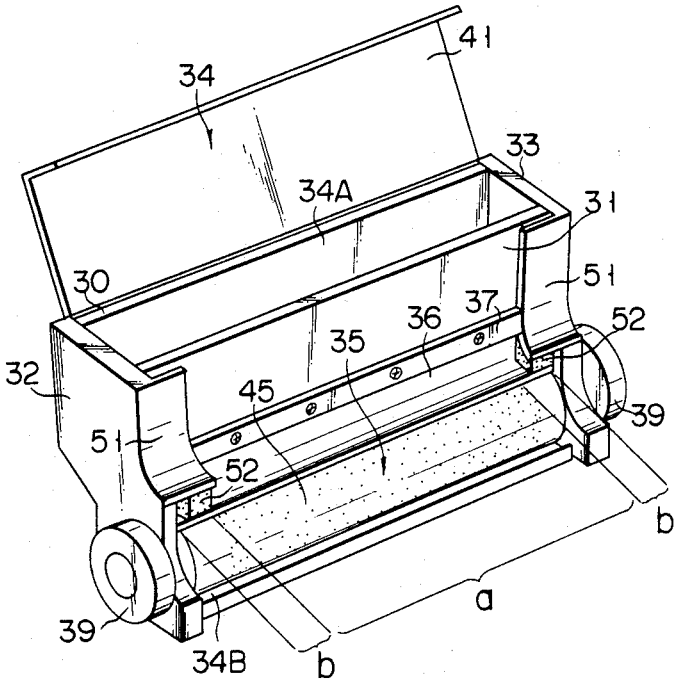
FIG. 8A is a perspective view schematically showing a first modification of the developing apparatus according to the second embodiment.
Figure 8B:
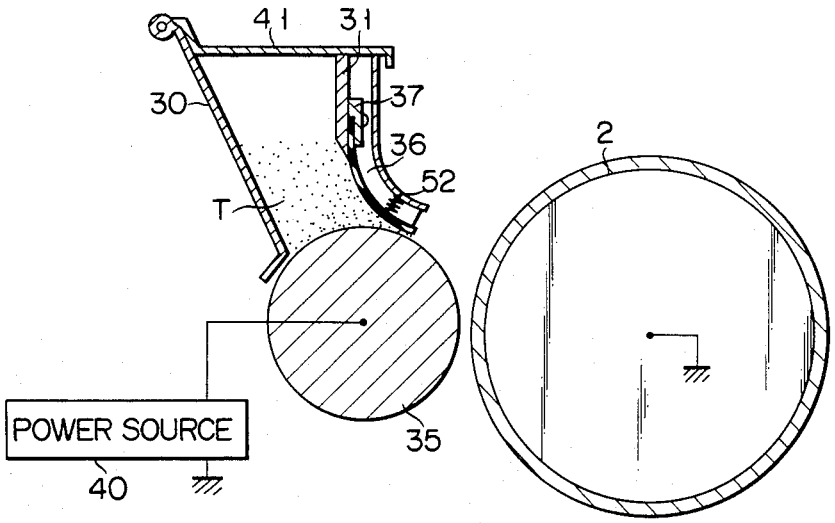
FIGS. 8B, 8C and 8D are sectional views schematically showing second, third and fourth modifications, respectively, of the developing apparatus according to the second embodiment.
Figure 8C:
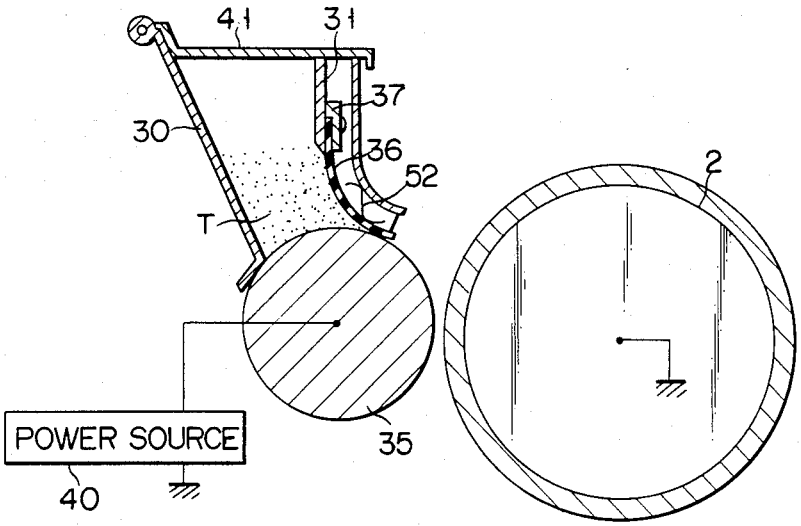
Figure 8D:
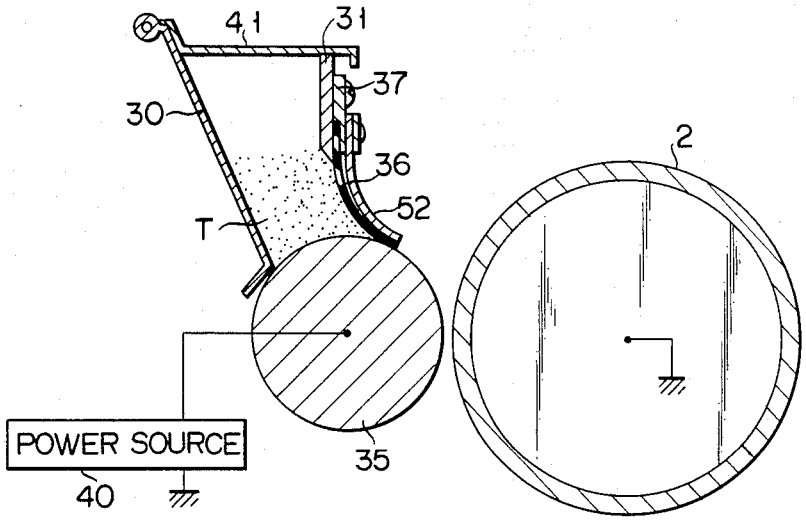

For securer pressure contact between the elastic blade 36 and the smooth surfaces 50, ribs 51 may be formed on the side frames 32 and 33, individually, as shown as a first modification in FIG. 8A. A backup member 52 made of urethane rubber or other material is fixedly sandwiched between each rib 51 and the elastic blade 36. The backup member 52 may be replaced with a coil spring as a second modification (FIG. 8B) or a leaf spring as a third modification (FIG. 8C). The arrangements of these modifications prevent the developing agent from leaking sideways and regulate the region for coating with improved reliability. The backup members 52 may be attached in any other way than the manners shown in FIGS. 8A, 8B and 8C. For example, as shown in a fourth modification in FIG. 8D, the backup members 52 formed of leaf springs or the like may be attached to both end portions of the blade holder 37 so that their free end portions are pressed against the elastic blade 36.

Also in the second embodiment, the same first rugged surface portion as provided in the first embodiment may be formed on the elastic blade. With this arrangement, as seen from the description of the first embodiment, the thin layer of the developing agent may be improved in uniformity.

It is to be understood that the present invention is not limited to the second embodiment, and that the members used in the second embodiment may be replaced with other members having the same functions for the same modifications described in connection with the first embodiment.

Figure 9:
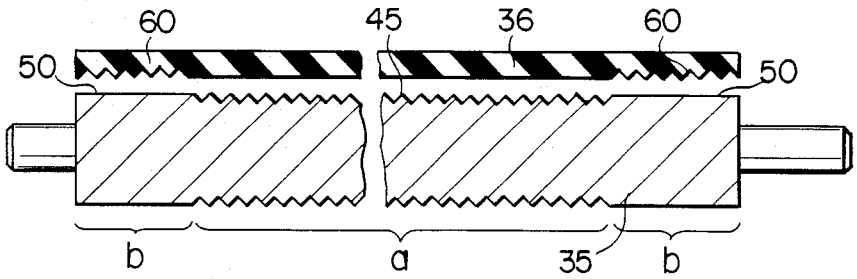
FIG. 9 is a sectional view schematically showing the principal part of a developing apparatus according to a third embodiment of the invention.

A developing apparatus according to a third embodiment of the invention will now be described in detail. This developing apparatus may also be applied to the copying machine shown in FIG. 1, and has substantially the same outline as the first embodiment shown in FIGS. 2 and 3. The third embodiment differs from the first embodiment in that the nondeveloping regions (with the nondeveloping width (b)) on each side of the second rugged surface portion 45 have smooth surfaces 50 (smoother than the second rugged surface portion 45), and that third rugged surface portions 60 are formed on those portions of the surface of the elastic blade 36 which face the two smooth surfaces 50, as shown in the sectional view of FIG. 9. The third rugged surface portions 60 need only be rough enough to give a relatively great resisting force (frictional resistance) to the developing agent thereon.

Figure 10:
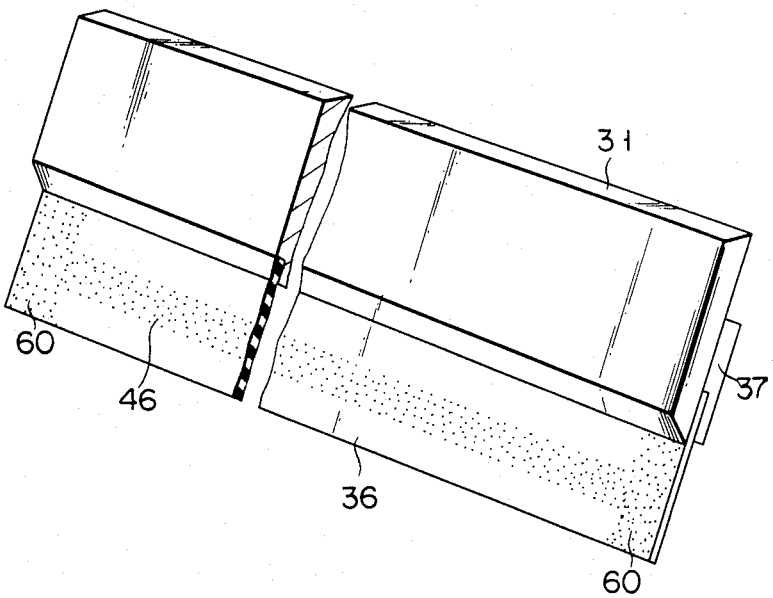
FIG. 10 is a perspective view schematically showing an elastic blade used in the developing apparatus of FIG. 9.

The third rugged surface portions 60 need only be formed at least near those regions of the elastic blade 36 which engage the developing roller 35. In the third embodiment, however, the third rugged surface portions 60 extend from top to bottom on the back side (facing the developing roller 35) of the elastic blade 36, as shown in FIG. 10. In the case of the third embodiment, the first rugged surface portion 46 need not always be formed on the elastic blade 36 which is pressed against the surface of the developing roller 35.

Figure 11A:
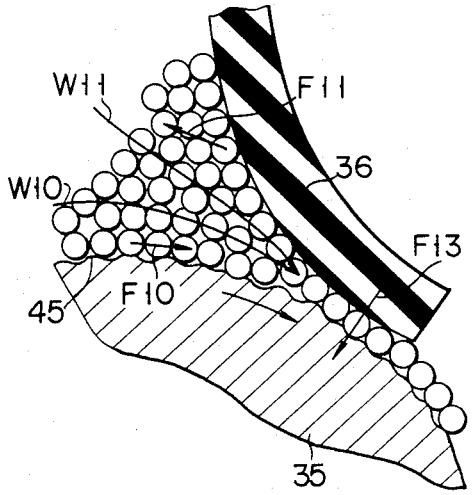
FIGS. 11A and 11B are sectional views for illustrating the operation of the developing apparatus of FIG. 9.

The elastic blade 36 is pressed against the developing roller 35 constructed in this manner. The developing agent is carried between the developing roller 35 and the elastic blade 36 while being frictionally charged. Hereupon, the second rugged surface portion 45 is formed on the surface of the developing roller 35. Therefore, a conveying force F10 of the developing roller 35 to carry the developing agent in contact with or near the surface of the developing roller 35 is increased. Thus, the developing agent near the surface of the developing roller 35 is fed in the direction of arrow W1 to flow in a satisfactory manner. Meanwhile, that surface portion of the elastic blade 36 which faces the second rugged surface portion 45 is not roughed. Therefore, the developing agent in contact with the elastic blade 36 is subjected only to a resisting force (frictional resistance) F11 smaller than the conveying force F10. As a result, the developing agent near the surface of the developing roller 35 flows actively and smoothly in the directions indicated by arrows W10 and W11 in FIG. 11A. The layer of the flowing developing agent is gradually reduced in thickness by a contact pressure F13 of the elastic blade 35 as the flow of the developing agent approaches the lower-course side of the elastic blade 36. Thus, a thin layer of the developing agent is formed on the surface of the developing roller 35.

Figure 11B:
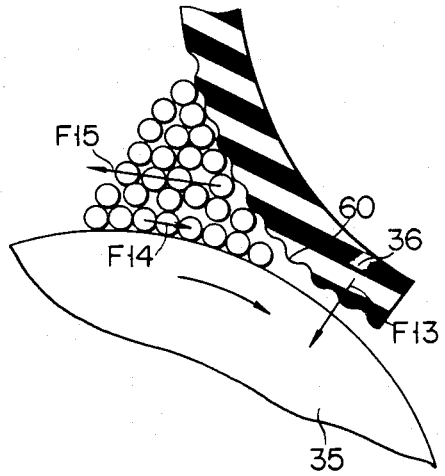

When the developing roller 35 rotates in the clockwise direction of FIG. 11B, the third rugged surface portions 60 of the elastic blade 36 are pressed against the smooth surfaces 50 of the developing roller 35. Therefore, the developing agent receiving the contact pressure from the elastic blade 36 slips on the smooth surfaces 50 and is subjected to only a very small conveying force F14. On the other hand, the developing agent touching the third rugged surface portions 60 of the elastic blade 36 is subjected to a relatively great resisting force (frictional resistance) F15. In consequence, the developing agent is prevented from flowing out through the space between the third rugged surface portions 60 and the developing roller 35. Accordingly, the developing agent T cannot easily move sideways around the boundary between the second rugged surface portion 45 and the smooth surfaces 50, and can effectively be prevented from leaking sideways. Thus, the region of the developing roller 35 to be coated with the developing agent may securely be restricted to the second rugged surface portion 45.

Also in the third embodiment, the same first rugged surface portion 46 as provided in the first embodiment may be formed on the elastic blade. With this arrangement, as seen from the description of the first embodiment, the thin layer of the developing agent may be improved in uniformity.

In the third embodiment, as in the second embodiment, the developing roller may be provided with the recess 47 of the predetermined depth whose bottom surface is formed of the first rugged surface portion 46. With this arrangement, as seen from the description of the second embodiment, the region of the developing roller to be coated with the developing agent may be defined more securely.

It is to be understood that the present invention is not limited to the third embodiment, and that the members used in the third embodiment may be replaced with other members having the same functions for the same modifications described in connection with the first embodiment.

In the first embodiment, as described in detail above, the elastic member may securely be prevented from being forced up by an uneven or irregular flow of the developing agent or foreign matter mixed therein, even though the developing agent is a one-component, nonmagnetic developing agent, so that a uniformly thin layer of the developing agent may be formed on the surface of the developing agent carrier, ensuring production of a visible image of good quality.

In the second and third embodiments, moreover, the region of the developing agent carrier to be coated with the developing agent may securely be defined, even though the developing agent is a one-component, nonmagnetic developing agent, so that the thin layer of the developing agent applied to the surface of the developing agent carrier may be protected against unevenness, ensuring production of a visible image of good quality.

What is claimed is:

1. A developing apparatus comprising a developing agent carrier for carrying a developing agent thereon, and an elastic member pressed against the surface of the developing agent carrier to apply the developing agent thereto, so that the developing agent is applied to the surface of the developing agent carrier by the elastic member to form a thin layer on the surface of the developing agent carrier, and that the thin layer is opposed to an image carrier at a predetermined space to deposit the developing agent on a latent image on the image carrier, wherein a first rugged surface portion is formed on that part of the surface of the elastic member which faces the developing agent, carrier, said first rugged surface portion being located in a region on the upper-course side with respect to the flow of the developing agent and not in contact with a monolayer of the developing agent touching the surface of the developing agent carrier.

2. A developing apparatus comprising a developing agent carrier for carrying a developing agent thereon, and an elastic member pressed against the surface of the developing agent carrier to apply the developing agent thereto, so that the developing agent is applied to the surface of the developing agent carrier by the elastic member to form a thin layer on the surface of the developing agent carrier, and that the thin layer is opposed to an image carrier at a predetermined space to deposit the developing agent on a latent image on the image carrier, wherein a recess of a predetermined depth is formed in the surface of the developing agent carrier, corresponding to a developing region, and a second rugged surface portion is formed on the bottom surface of the recess.

3. The apparatus according to claim 2, wherein smooth surfaces are formed on nondeveloping regions of the surface of the developing agent carrier on both sides of the recess.

4. The apparatus according to claim 3, wherein each said smooth surface has a surface roughness less than 0.01D where D is the average particle size of the developing agent.

5. The apparatus according to claim 3, wherein the depth of the second rugged surface portion below the smooth surfaces is set so that the surface of the thin layer of the developing agent on the second rugged surface portion is substantially flush with the smooth surfaces.

6. The apparatus according to claim 5, further comprising a backup member for pressing the elastic member against the smooth surfaces.

7. The apparatus according to claim 2, wherein said elastic member has a first rugged surface portion constituting that part of the surface of the elastic member which faces the developing agent carrier, the first rugged surface portion being located in a region on the upper-course side with respect to the flow of the developing agent and not in contact with a monolayer of the developing agent touching the surface of the developing agent carrier.

8. The apparatus according to claim 7, wherein said first rugged surface portion has a surface roughness of 0.1D to 2.0D where D is the average particle size of the developing agent.

9. The apparatus according to claim 2, wherein said second rugged surface portion has a surface roughness of 0.07D to 1.5D where D is the average particle size of the developing agent.

10. A developing apparatus comprising a developing agent carrier for carrying a developing agent thereon, and an elastic member pressed against the surface of the developing agent carrier to apply the developing agent thereto, so that the developing agent is applied to the surface of the developing agent carrier by the elastic member to form a thin layer on the surface of the developing agent carrier, and that the thin layer is opposed to an image carrier at a predetermined space to deposit the developing agent on a latent image on the image carrier, wherein a second rugged surface portion and smooth surfaces on each side thereof are formed on the surface of the developing agent carrier, said smooth surfaces corresponding to nondeveloping regions, and third rugged surface portions are formed on those portions of the surface of the elastic member which face the smooth surfaces.

11. The apparatus according to claim 10, wherein a second rugged surface portion is formed on the surface of the developing agent carrier, corresponding to a developing region, and said smooth surfaces are located individually on both sides of the second rugged surface portion.

12. The apparatus according to claim 11, wherein a recess is formed in the surface of the developing agent carrier, corresponding to the developing region, and said second rugged surface portion is formed on the bottom surface of the recess.

13. The apparatus according to claim 12, wherein the depth of said recess is set so that the surface of the thin layer of the developing agent on the second rugged surface poriton is substantialiy flush with the smooth surfaces.

14. The apparatus according to claim 12, wherein said elastic member has a first rugged surface portion constituting that part of the surface of the elastic member which faces the developing agent carrier, the first rugged surface portion being located in a region on the upper-course side with respect to the flow of the developing agent and not in contact with a monolayer of the developing agent touching the surface of the developing agent carrier.

15. The apparatus according to claim 14, wherein said first rugged surface portion has a surface roughness of 0.1D to 2.0D where D is the average particle size of the developing agent.

* * * * *